US007600565B2

(12) United States Patent
Moyes

(10) Patent No.: US 7,600,565 B2
(45) **Date of Patent: *Oct. 13, 2009**

(54) DOWNHOLE TRIGGER APPARATUS

(75) Inventor: Peter Barnes Moyes, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/034,243

(22) Filed: Feb. 20, 2008

(65) Prior Publication Data

US 2008/0135231 A1 Jun. 12, 2008

Related U.S. Application Data

(63) Continuation-in-part of application No. 11/773,124, filed on Jul. 3, 2007, now abandoned, and a continuation-in-part of application No. 11/491,698, filed on Jul. 24, 2006.

(30) Foreign Application Priority Data

Jul. 22, 2005 (GB) ..... 0515068.5

(51) Int. Cl.
*E21B 23/00* (2006.01)

(52) U.S. Cl. ..... 166/123; 166/125; 166/181

(58) Field of Classification Search ..... 166/123, 166/125, 181

See application file for complete search history.

(56) References Cited

U.S. PATENT DOCUMENTS 3,837,403 A * 9/1974 Mott ..... 166/374
6,896,049 B2 5/2005 Moyes
7,000,705 B2 2/2006 Buyers et al.

FOREIGN PATENT DOCUMENTS

WO WO 02/04783 1/2002

OTHER PUBLICATIONS

Halliburton, Data Acquisition Services, Mar. 2005. 28 pages.
Nan Gall Energy, Trigger, Main Features, date unknown, 2 pages. Retrieved online on Oct. 10, 2008 from: http://www.nangall.com/products/inteli_triggers/trigger.htm.
Nan Gall Energy, Electronic Timer, Main Features, date unknown, 1 page Retrieved online on Oct. 10, 2008 from: http://www.nangall.com/products/inteli_triggers/Electronic_Timer.htm.

* cited by examiner

*Primary Examiner*—Jennifer H Gay
*Assistant Examiner*—Elizabeth C Gottlieb
(74) *Attorney, Agent, or Firm*—Cantor Colburn LLP

(57) ABSTRACT

Disclosed herein is a downhole triggering tool. The tool includes a tool-engaging portion movable from a first position to a second position under the action of an external force, and a release mechanism for selectively permitting movement of the tool-engaging portion from the first position to the second position, the tool-engaging portion is restrained against the external force by the release mechanism through a plurality of force reducing mechanisms.

10 Claims, 15 Drawing Sheets

DOWNHOLE TRIGGER APPARATUS

CROSS REFERENCE TO RELATED APPLICATIONS

This application is a continuation in part application of U.S. Ser. No. 11/773,124, filed Jul. 3, 2007 and is also a continuation in part application of U.S. Ser. No. 11/491,698, filed Jul. 24, 2006, both which claim priority to Great Britain provisional application, 0515068.5, filed Jul. 22, 2005, the entire contents of each of which is incorporated herein by reference.

FIELD OF THE INVENTION

The present invention relates to an apparatus for activating a downhole tool, and in particular, but not exclusively, to a downhole tool triggering apparatus.

BACKGROUND OF THE INVENTION

Many downhole well bore tools require to be activated when located downhole at the required location or depth. There are many systems available, which may be utilized to perform such actuation, and may include downhole motors, piston arrangements or the like. However, it is sometimes the case that such systems require to be powered or carefully monitored and controlled from surface level to ensure reliable and correct operation. This therefore required relatively complex arrangements of conduits and power cables and the like to be run from surface level to the required depth.

Simplified arrangements, therefore, of downhole tool actuation are desirable in the art.

BRIEF DESCRIPTION OF THE INVENTION

Disclosed herein relates to a selectively operable timing device in operable communication with a force reducing mechanism, the mechanism restraining an effect of an external force on a tool member, that force being restrained to time actuation of a separate tool.

Further disclosed herein is an apparatus that relates to a downhole triggering tool. The tool comprising, a tool-engaging portion movable from a first position to a second position under the action of an external force. The tool further comprising, a release mechanism for selectively permitting movement of the tool-engaging portion from the first position to the second position, the tool engaging portion being restrained against the external force by the release mechanism through a force reducing mechanism.

Further disclosed herein is an apparatus that relates to a downhole tool. The tool comprising, a setting tool comprising a fluid actuated piston arrangement in selective fluid communication with a fluid source, and a downhole tool-engaging portion. The downhole tool further comprising a triggering tool comprising a setting tool-engaging portion movable from a first position to prevent fluid communication between the fluid source and piston arrangement of the setting tool, and a second position to permit fluid communication between the fluid source and piston arrangement. Additionally, the setting tool-engaging portion is moved under the action of an external force. The triggering tool further comprising a release mechanism for selectively permitting movement of the setting tool-engaging portion from the first position to the second position, the external force being transmitted to the release mechanism via a force reducing mechanism.

BRIEF DESCRIPTION OF THE DRAWINGS

These and other aspects of the present invention will now be described, by way of example only, with reference to the accompanying drawings, in which.

DETAILED DESCRIPTION OF THE INVENTION

Figure 1:
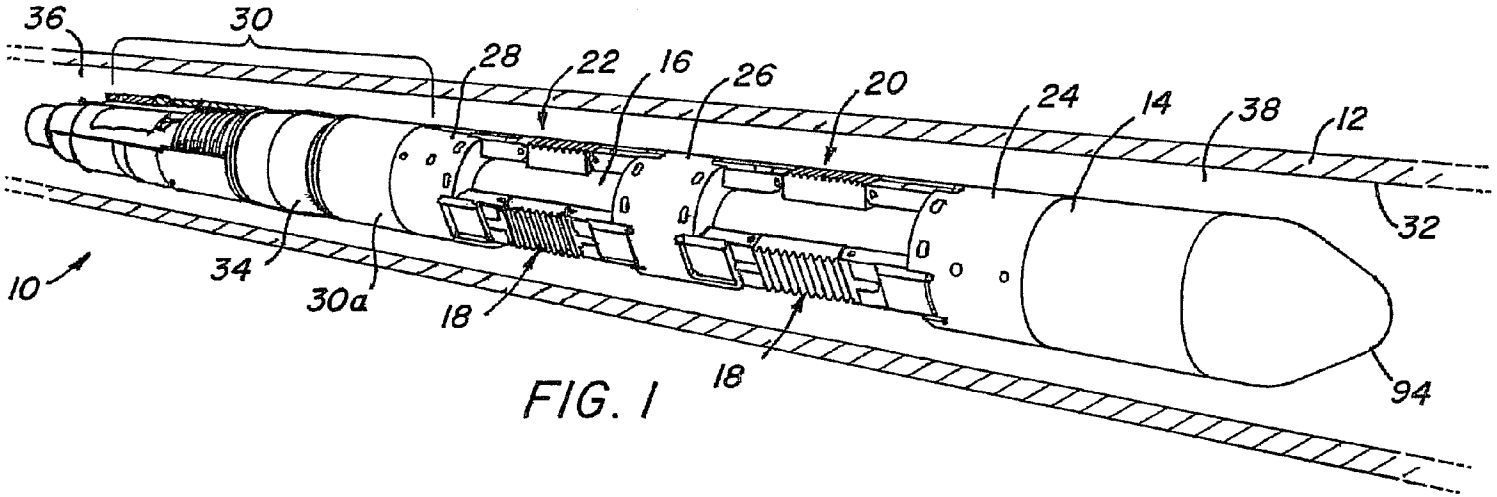
FIG. 1 is a perspective view of a bridge plug tool shown in a retracted configuration.
Figure 2:
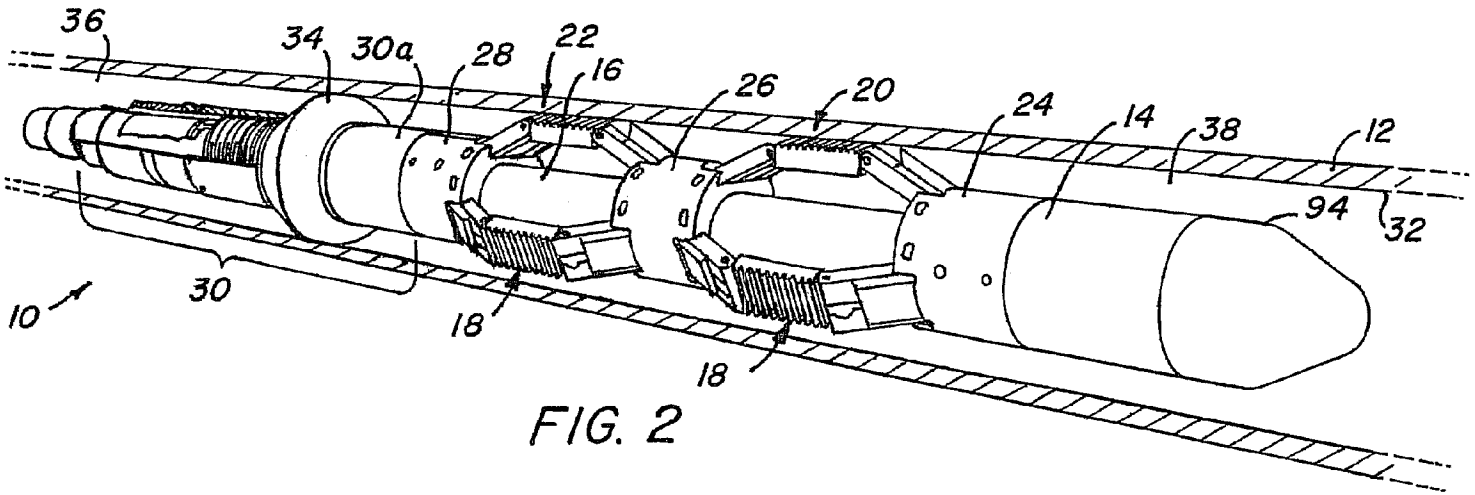
FIG. 2 is a perspective view of the tool of FIG. 1, shown in an extended configuration.

Reference is first made to FIGS. 1 and 2 of the drawings, which show perspective views of a downhole bridge plug tool, generally identified by reference numeral 10. The tool 10 is shown located in a portion of a cased well bore 12, and in FIG. 1 is shown in a retracted, first configuration, and in FIG. 2 is shown in an expanded, second configuration.

The tool 10 comprises an outer tool body 14 mounted on a tool mandrel 16, and a number of extendable assemblies 18 mounted on an outer surface of the tool 10. As shown, the extendable assemblies 18 are arranged in two axially spaced sets, 20, 22, wherein each set 20, 22 comprises three extendable assemblies 18 circumferentially distributed about the outer surface of the tool 10. The extendable assemblies 18 of the first set 20 are pivotally mounted between a first support portion 24 and a second support portion 26, and the extendable assemblies 18 of the second set 22 are pivotally mounted between the second support portion 26 and a third support portion 28. The first support portion 24 is fixed relative to the tool mandrel 16 and the second and third support portions 26, 28 are axially slidably mounted relative to the tool mandrel 16.

The tool 10 further comprises an outer sleeve assembly 30 slidably mounted relative to the tool mandrel 16, wherein a lower end 30*a* of the outer sleeve assembly 30 engages the third support portion 28. In use, the sleeve assembly 30 is caused to move downwardly relative to the tool mandrel 16 towards the leading end nose 94 to transmit a force to the third support portion 28, thus causing the second and third support portions 26, 28 to be displaced downwardly relative to the tool mandrel 16 to cause the extendable assemblies 18 to extend radially outwardly, as shown in FIG. 2, into engagement with the wall 32 of the bore 12. In this configuration, the tool is advantageously secured within the bore 12 by the interference engagement created between the extendable assemblies 18 and bore wall. The outer sleeve assembly 30 may be caused to move downwardly relative to the tool mandrel 16 by an appropriate setting tool (not shown in FIGS. 1 and 2), such as that shown in FIGS. 10 to 13.

The outer sleeve assembly 30 incorporates a sealing member 34 which is adapted to be moved between a retracted configuration, as shown in FIG. 1, and an extended or sealing configuration, as shown in FIG. 2. The arrangement is such that when the extendable assemblies 18 are engaged with the bore wall 32 to provide support, continued downward movement of the outer sleeve assembly 30 will cause the sealing member to be deformed radially outwardly and ultimately brought into sealing engagement with the bore wall 32. Thus, the established seal may be utilized to prevent or at least minimize the transmission of fluids between upper and lower regions 36, 38 of the well bore 12.

A more detailed description of the tool 10 will now be given with reference to FIG. 3 in which there is shown a longitudinal sectional view of the tool 10, in the configuration of FIG. 1. For clarity, the tool 10 in FIG. 3 is presented on 4 separate sheets, in FIGS. 3A-3D.

Figure 3A:
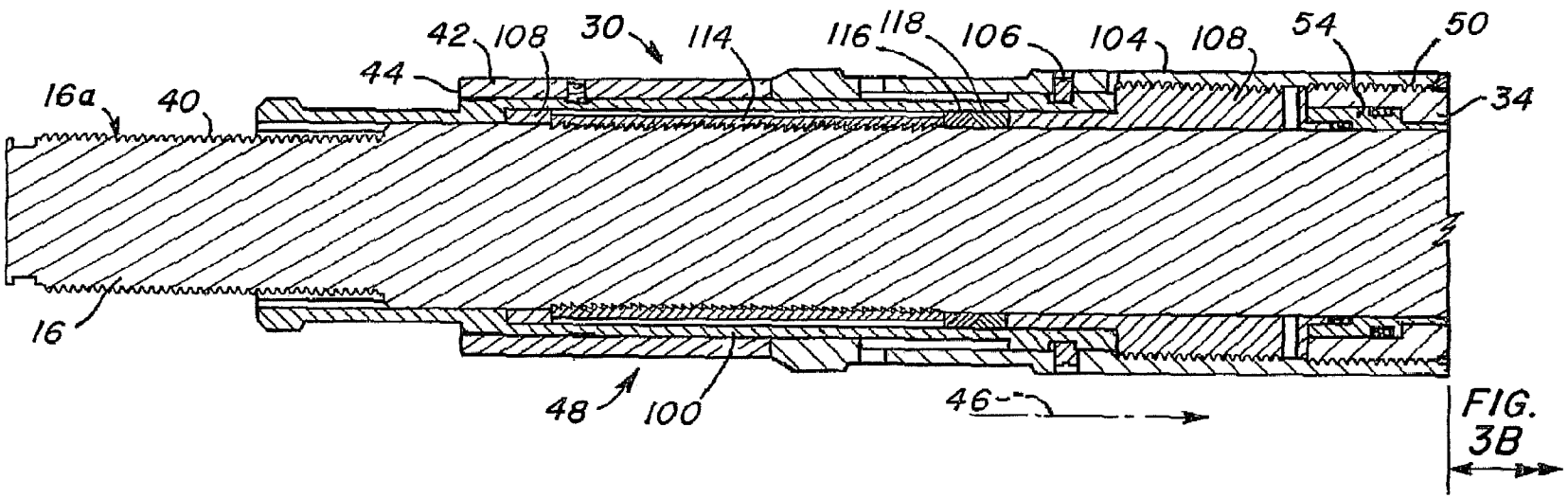
FIGS. 3A to 3D present a longitudinal sectional view of the tool of FIG. 1.

An upper portion of the tool 10 is shown in FIG. 3A, in which there is shown a portion 16*a* of the outer sleeve assembly 30 mounted on the tool mandrel 16. An end portion of the mandrel 16 incorporates a threaded portion 40 for securing to a further tool, such as a setting tool, either directly or via a suitable connector. The outer sleeve assembly 30 comprises an outer sleeve load transfer sub 42 having an annular end face 44 against which a loading tool, such as a setting tool, may abut to transmit an axial force to the load transfer sub 42, which force is ultimately transmitted to the third support portion 28 (FIGS. 1 and 2) and seal portion 34 (FIGS. 1 and 2) to reconfigure the tool 10. Accordingly, when the tool 10 is reconfigured, the outer sleeve assembly 30 is moved downwardly, in the direction of arrow 46, relative to the tool mandrel 16.

The outer sleeve assembly 30 further comprises a ratchet arrangement, generally indicated by reference numeral 48, adapted to freely permit movement of the sleeve assembly 30 in the direction of arrow 46 relative to the tool mandrel 16, and to selectively permit relative movement of the outer sleeve assembly 30 and tool mandrel 16 in a direction opposite to arrow 46. Thus, the ratchet arrangement 48 is adapted to temporarily lock the tool 10 in the extended configuration (shown in FIG. 2). A detailed description of the ratchet arrangement 48 and its operation is provided hereinafter below.

Figure 3B:
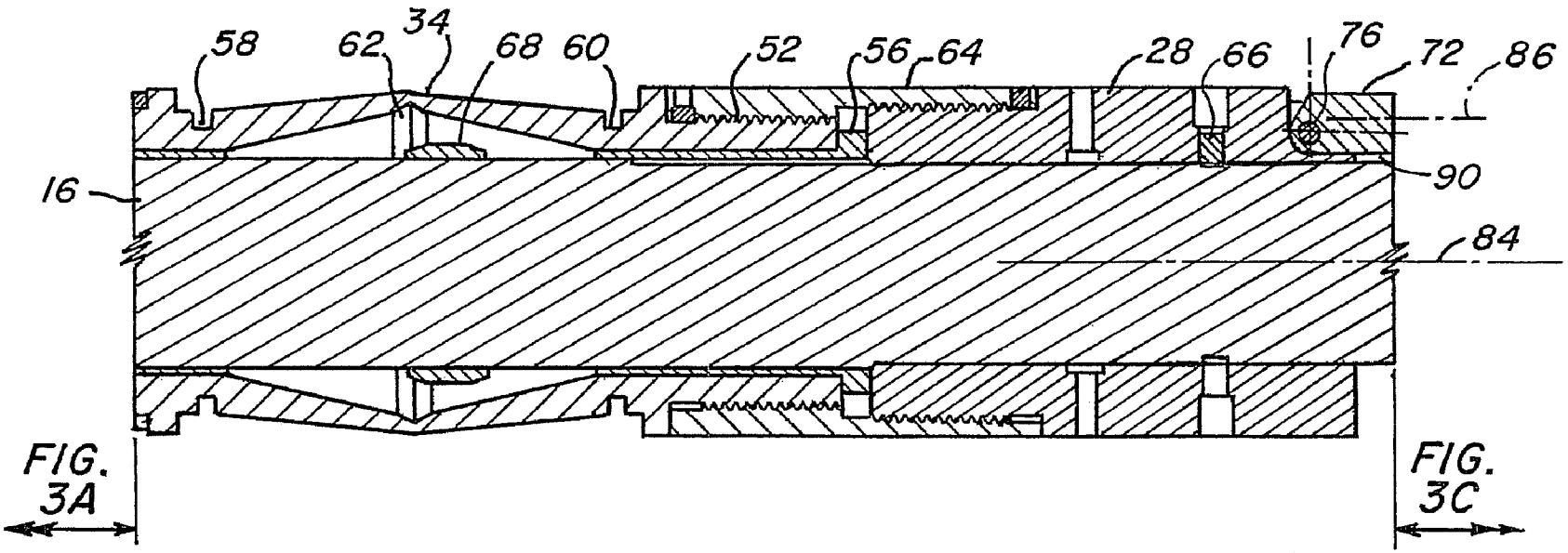

Reference is now made to FIG. 3B in which the remaining portion of the outer sleeve assembly 30 is shown. As noted above, the assembly 30 comprises sealing member 34, which is secured with the sleeve assembly 30 by threaded connections 50, 52, and is supported by seal supports 54, 56. The sealing member defines upper and lower annular notches 58, 60 in an outer surface thereof, and a central annular notch 62 in an inner surface thereof, such that when a predetermined axial load is imparted on the outer sleeve assembly 30, the sealing member 34 deforms at the location of the notches 58, 60, 62 to provide the required seal extension. The sealing member may be of a form such as that described in applicant's co-pending international patent application, publication number WO 02/04783.

The third support portion 28 is secured to the lower end of the sealing member 34 via a threaded connector sleeve 64. When the tool 10 is initially set in the retracted position, the third support portion 28 is secured to the tool mandrel 16 via one or more shear screws 66 which are adapted to be sheared when the outer sleeve assembly 30 is subjected to a predetermined axial load. Once the shear screws 66 have been sheared, the third support portion 28 may then be displaced axially relative to the tool body 16 by the outer sleeve assembly 30, thus causing the extendable assemblies 18 to be extended radially outwardly. This arrangement assists to prevent unintentional extension of the extendable assemblies 18, for example when running into a well bore.

In the embodiment shown, the axial force required to shear the shear screws 66 is less than that required to deform the sealing member 34. Accordingly, any axial load applied to the outer sleeve assembly 30 will advantageously be transmitted by the sealing member 30 and applied to the third support portion 28 via the connector sleeve 64 in order to shear the shear screws 66, and subsequently effect extension of the extendable assemblies 18, without any deformation of the sealing member 34 occurring. Once the extendable assemblies 18 engage the wall of a bore, an increased reaction force will be achieved such that an increased force may be applied by the outer sleeve assembly 30 to effect deformation and activation of the sealing member 34. Thus, the tool 10 is adapted to be located at the required bore depth, fixed in location by the extendable assembly 18, and then establish a seal via the sealing member 34.

A collar 68 is mounted about the outer surface of the tool mandrel 16, beneath the sealing member 34. In use, when the sealing member 34 is being deformed, the seal supports 54, 56 will engage either side of the collar 68, thus limiting the amount of deformation of the sealing member 34 which may be achieved. The collar 68 may be fixed to the tool mandrel 16, or may be slidably mounted on the mandrel 16.

Figure 3C:
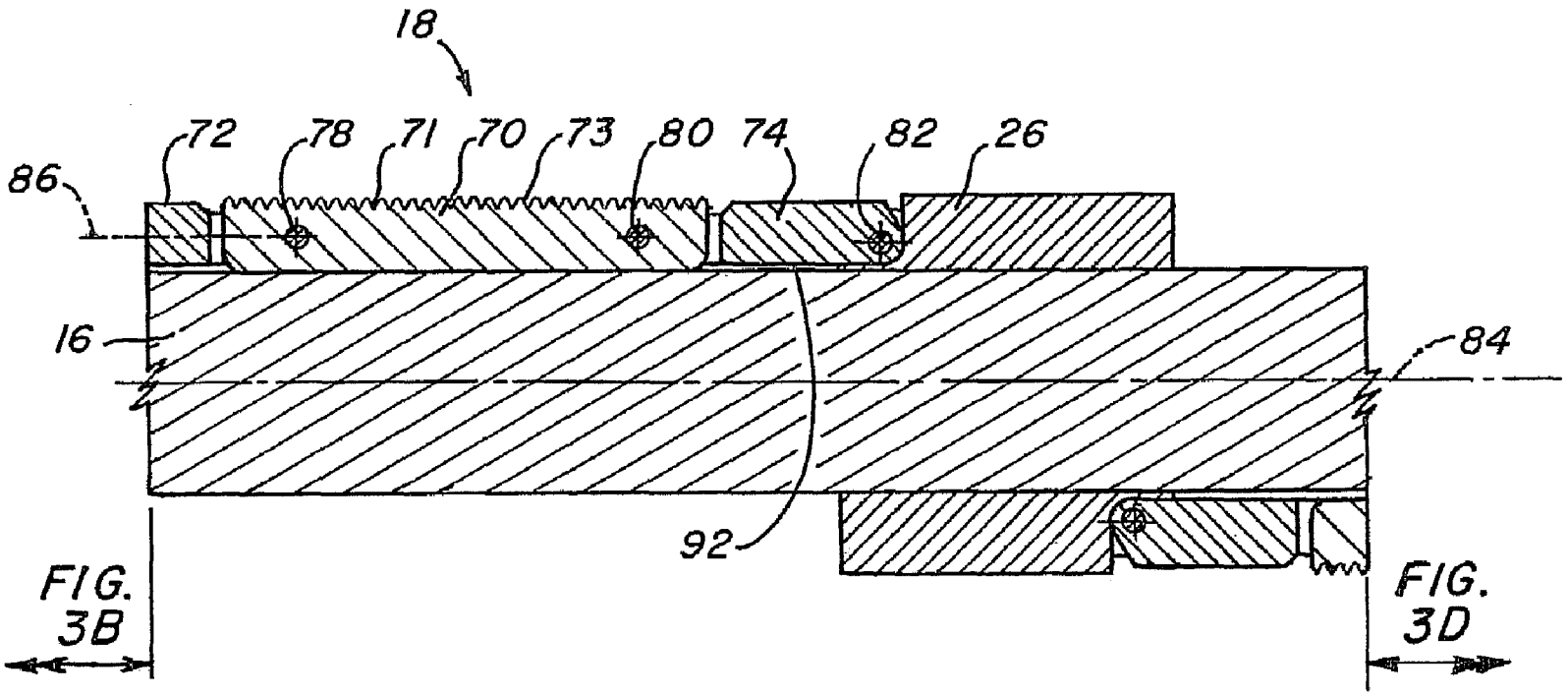
Figure 3D:
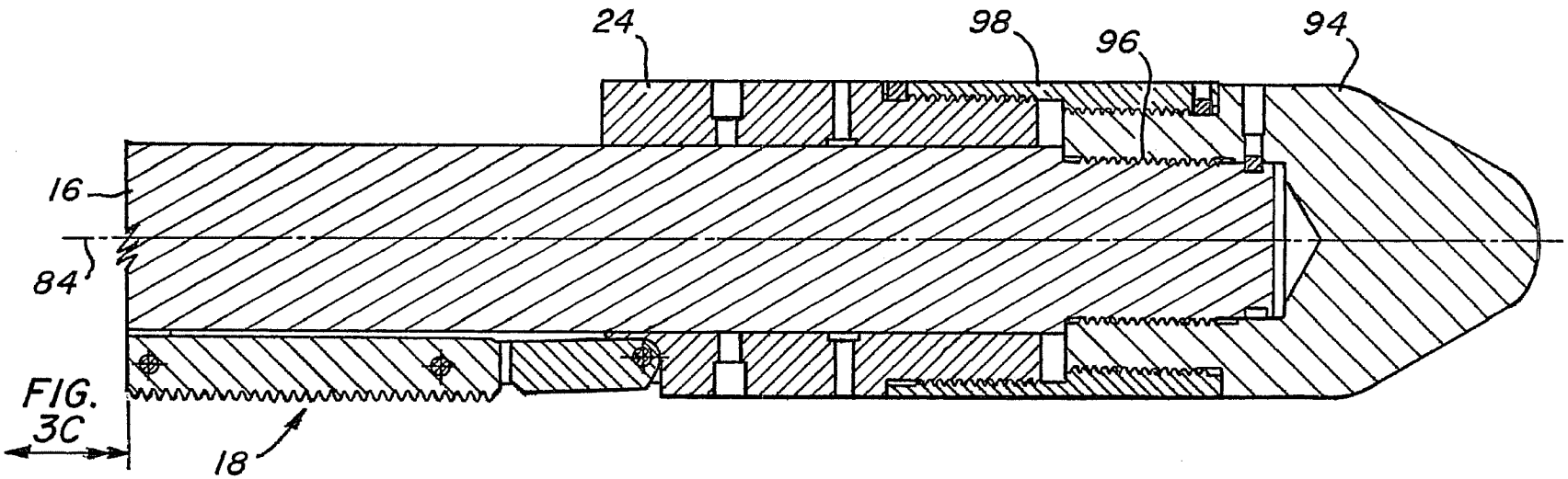

The form of the extendable assemblies 18 will now be described with reference to FIG. 3C, in which a longitudinal sectional view of a complete extendable assembly 18 of the second set 22 (FIGS. 1 and 2) is shown, which extends between the third support portion 28 and second support portion 26. As noted above, the second support portion 26 is slidably mounted relative to the tool mandrel 16 such that relative downward movement of the second support portion 26 will be achieved when the third support portion 28 is caused to move axially by the outer sleeve assembly 30. The second support portion 26 will be caused to move at a slower rate of displacement than the third support portion 28 in order to establish relative movement therebetween. Also shown in FIG. 3C is a portion of an extendable assembly 18 of the first set 20 (FIGS. 1 and 2), which extends between the second support portion 26 and the first support portion 24 (FIG. 3D). As previously noted, the first support portion 24 is fixed relative to the tool mandrel 16. Accordingly, when the outer sleeve assembly 30 applies an axial force, relative downward movement of the second and third support portions 26, 28 with respect to the tool mandrel 16 will result in extension of the extendable assemblies 18.

Each extendable assembly 18 comprises a central engaging member 70 supported between first and second connecting members 72, 74. The outer surface 71 of the engaging member 70 is adapted to engage the wall surface of the bore within which the tool 10 is located. In the embodiment shown, the outer surface 71 of the engaging member comprises serrations 73 to aid the grip between the member 70 and bore wall. Alternatively, tungsten carbide inserts or the like may be utilized.

As shown in the complete example in FIG. 3C, one end of the first connecting member 72 is pivotally coupled to the third support portion 28 about pivot axis 76, and an opposite end of the first connecting member 72 is pivotally coupled to the engaging member 70 about pivot axis 78. Similarly, one end of the second connecting member 74 is pivotally coupled to the engaging member 70 about pivot axis 80, and an opposite end of the second connecting member 74 is pivotally coupled to the second support portion 26 about pivot axis 82. The pivot axes 76, 78, 80, 82 are aligned parallel with each other, and are obliquely aligned and radially offset from the central longitudinal axis 84 of the tool 10.

In the preferred arrangement shown in the Figures, pivot axes 76, 78 are laterally offset from each other relative to the central axis 86 of the first connecting member 72. That is, pivot axis 76 is positioned closer to an inner surface 90 of the first connecting member 72 than pivot axis 78. In a similar fashion, pivot axis 82 is positioned closer to the inner surface 92 of the second connection member 74 than axis 80. This specific arrangement of the respective pairs of pivot axes 76, 78 and 80, 82 advantageously results in the transmission of an axial force, applied by the outer sleeve assembly 30, between the offset pivot axes pairs at an oblique angle relative to the longitudinal axis 84 of the tool 10, such that the engaging member 70 will consistently be moved radially outwardly. Arranging the pivot axes in the particular manner shown and described beneficially eliminates or at least minimizes the possibility of the engaging members 70 being forced in a radially inward direction which would cause the extendable assemblies 18 to become jammed, which may cause premature extension of the sealing member 34.

The lower end of the tool 10 is shown in FIG. 3D. A conical nose portion 94 is secured to the lower end of the tool mandrel 16 via a threaded connection 96. The first support portion 24 is secured to the nose portion 94 via a threaded connector sleeve 98, such that the first support 24 portion is at least axially fixed relative to the tool mandrel 16.

The form and function of the ratchet arrangement 48, initially shown in FIG. 3A, will now be described in detail with reference to FIGS. 4 to 7.

Figure 4:
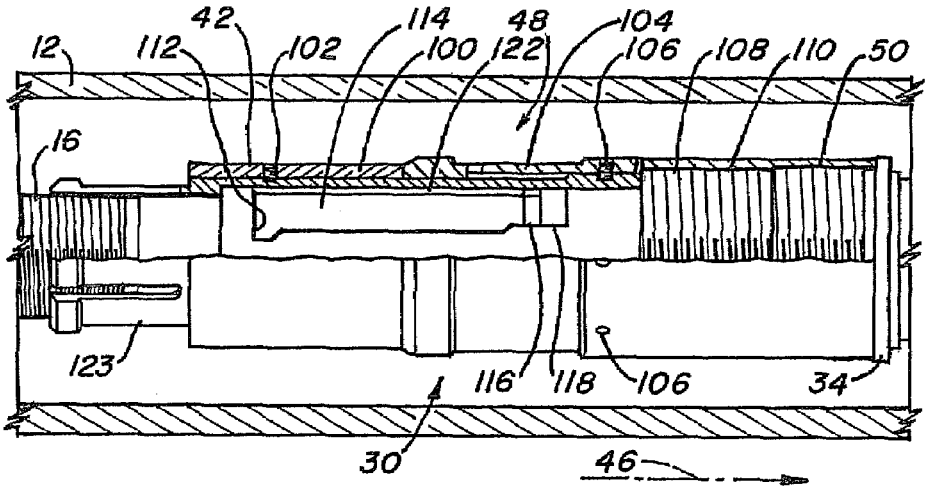
FIGS. 4 to 7 are enlarged part sectional views of a ratchet arrangement of the tool of FIG. 1.
Figure 5:
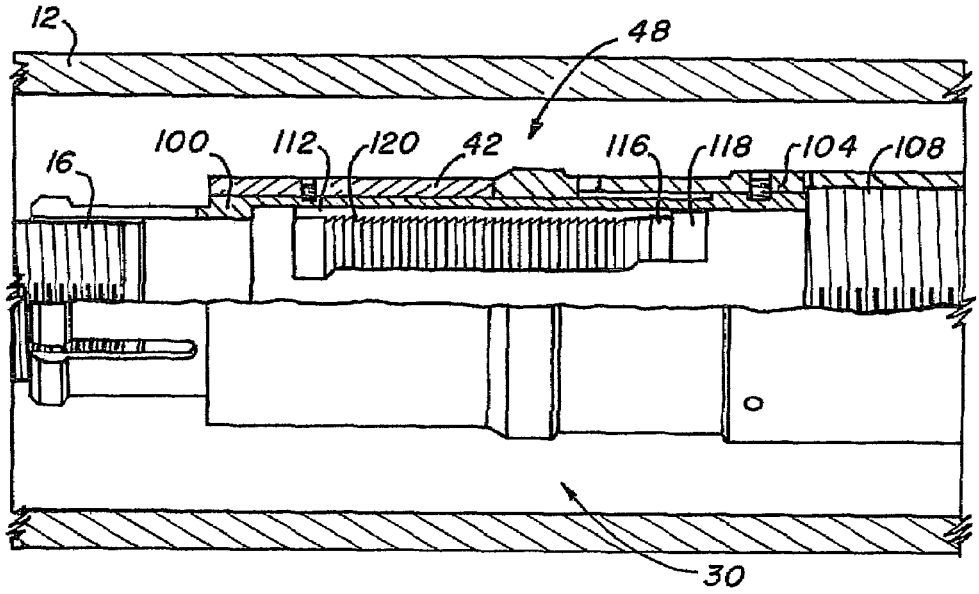
Figure 6:
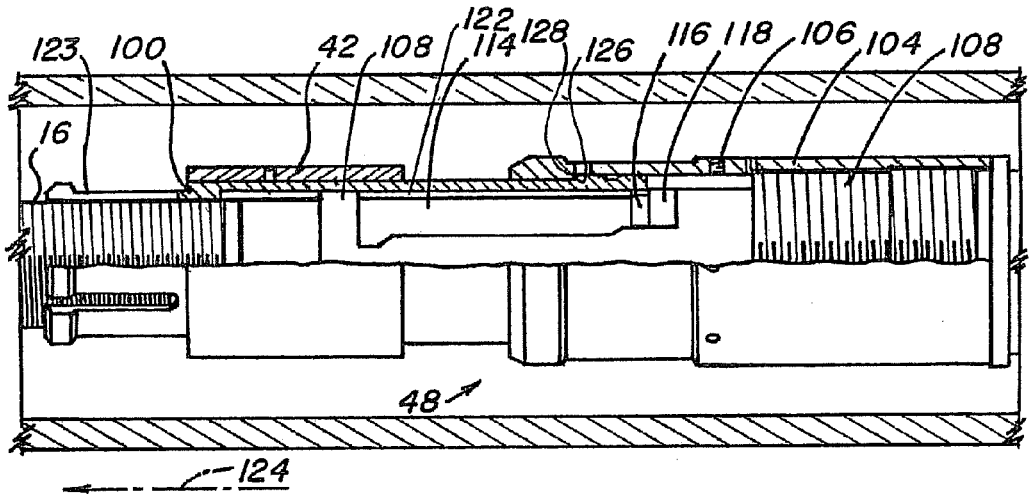

Reference is initially made to FIG. 4 in which there is shown a part sectional view of the tool 10 in the region of the ratchet arrangement 48. The outer sleeve assembly 30 comprises an outer sleeve or load transfer sub 42, which as noted above is adapted to transfer a load applied from an external tool. The sub 42 is secured to an inner sleeve 100 via a grub screw 102, and the inner sleeve 100 is also initially secured to an outer release sleeve 104 via a plurality of shear screws 106. The outer release sleeve 104 is secured to the upper end of the sealing member 34 by the threaded connection 50. Additionally, the outer release sleeve 104 is also secured to a ratchet mandrel 108 via a threaded connection 110. Thus, the arrangement is such that during normal use of the tool a permanent connection is provided between the sub 42 and inner sleeve 100, and a permanent connection is provided between the outer release sleeve 104, sealing member 34 and ratchet mandrel 108, while the inner sleeve 100 and outer release sleeve 104 are temporarily secured together by virtue of the shear screws 106.

The ratchet mandrel 108 defines an aperture 112 within which is located a ratchet component 114, spacer element 116 and a ratchet reverser component 118. The ratchet component 114 defines a ratchet profile on an inner surface thereof, which is adapted to engage and cooperate with a ratchet profile 120 on the outer surface of the tool mandrel 16. The ratchet component 114 is removed in FIG. 5 to clearly show the ratchet profile 120 of the tool mandrel 16. Referring again to FIG. 4, when in use, the ratchet arrangement 48 will permit movement of the outer sleeve assembly 30 in the direction of arrow 46. That is, the ratchet profiles on the ratchet component 114 and tool mandrel 16 will cooperate to ratchet the ratchet component 114 radially outwardly into an annular cavity 122 defined between the inner sleeve 100 and the ratchet mandrel 108. However, when relative movement of the tool mandrel 16 and outer sleeve assembly 30 is attempted in the opposite direction to that indicated by arrow 46, cooperation of the ratchet profiles on the tool mandrel 16 and ratchet component 114 will cause the outer sleeve assembly 30 and tool mandrel 16 to become axially locked together.

When it is required to reconfigure the tool 10 from the extended configuration to the retracted configuration, it is necessary to disengage the ratchet profiles of the ratchet component 114 and tool mandrel 16. To achieve this, a tool (not shown) is coupled to the inner sleeve 100 via fishneck 123, wherein the tool pulls on the inner sleeve 100 in the direction of arrow 124 shown in FIG. 6, reference to which is now made. The tool used to pull on the inner sleeve 100 may be the same setting tool used to position the extendable assemblies 18 and sealing member 34 into extended configurations. Alternatively, a different tool may be used. When a predetermined axial force is achieved by the tool pulling on the inner sleeve 100, the shear screws 106 will shear, thus severing the connection between the inner sleeve 100 and the outer release sleeve 104, permitting the inner sleeve 100 and load transfer sub 42 to be displaced upwardly in the direction of arrow 124. Upward displacement of the inner sleeve 100 will be permitted until an annular face 126 of the inner sleeve 100 engages an annular face 128 of the outer release sleeve 104. In this position, the ratchet reverser component 118 is no longer enveloped by the inner sleeve 100.

Figure 7:
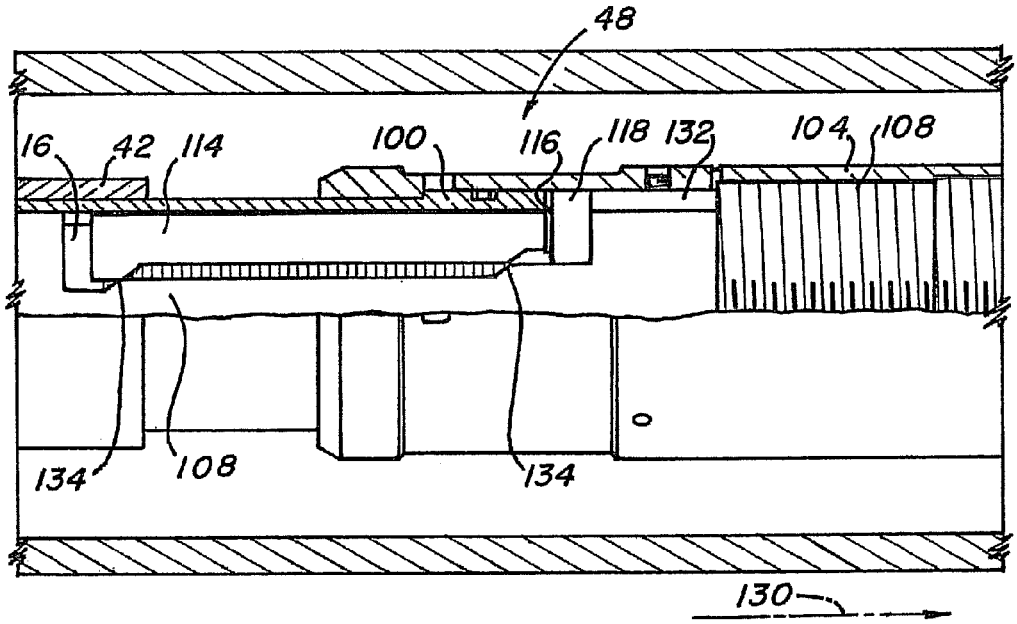

Reference is now made to FIG. 7 of the drawings in which there is shown an enlarged view of the ratchet arrangement 48, shown in a released position. When the inner sleeve 100 has been displaced to uncover the ratchet reverser component 118, an axial force may be applied to the tool mandrel 16 to move the mandrel in the direction of arrow 130 relative to the outer sleeve assembly 30. Movement of the tool mandrel 16 in this direction will translate the ratchet component 114 in the same direction by virtue of the engaging ratchet profiles 120 such that the spacer element 116 is forced under the ratchet reverser component 118 to displace the component 118 radially outwardly into the annular space 132 previously occupied by the inner sleeve 100. Furthermore, movement of the ratchet component 114 in the direction of arrow 130 will cause the ratchet component 114 to be displaced radially outwardly of the aperture 112 by cooperation of engaging ramp profiles 134 on the ratchet component 114 and ratchet mandrel 108, thus disengaging the ratchet profiles to permit the tool mandrel 16 to then be freely displaced in the direction of arrow 130 relative to the outer sleeve assembly 30 in order to move the extendable assemblies 18 and sealing member 34 towards a retracted configuration, as discussed below with reference to FIGS. 8 and 9.

Figure 8:
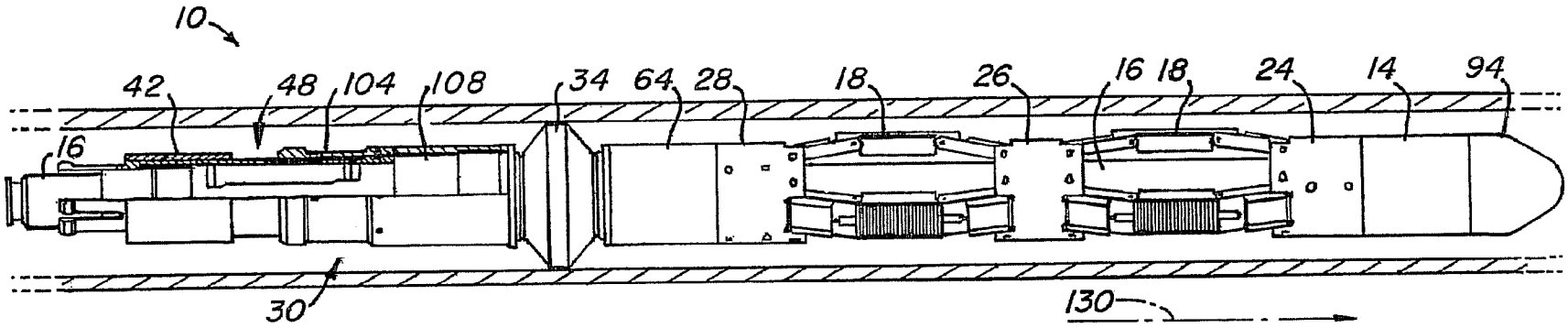
FIGS. 8 and 9 are perspective views of the tool of FIGS. 1, showing the tool being moved to a retracted configuration.
Figure 9:
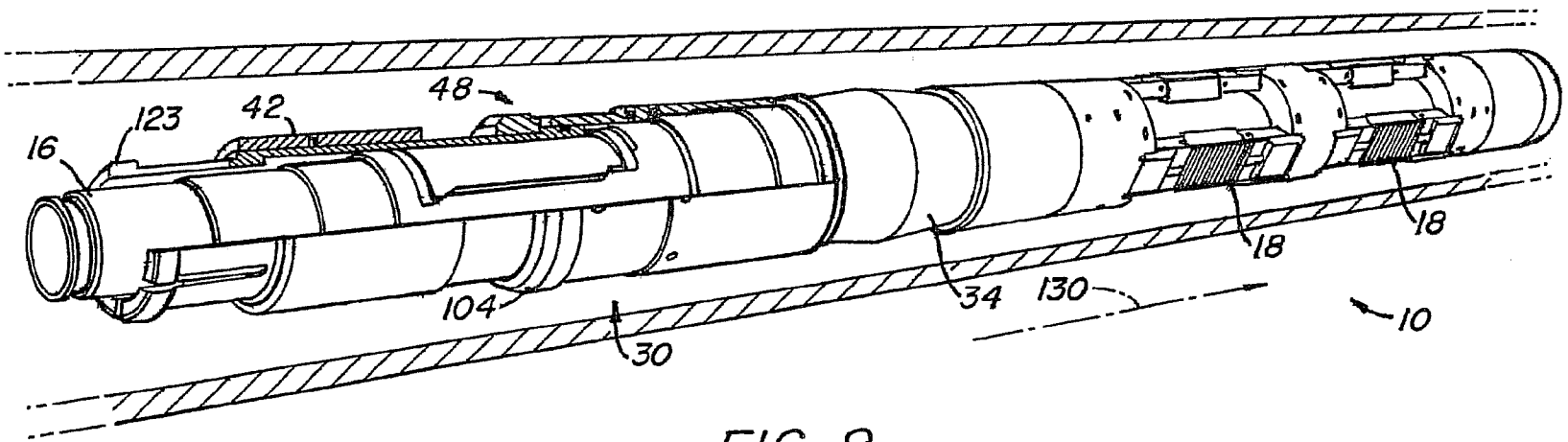

Referring initially to FIG. 8, which is a part sectional side view of the tool 10, when the ratchet arrangement 48 is released, downward movement of the tool mandrel 16 in the direction of arrow 130 relative to the outer sleeve assembly 30 will initially cause the extendable assemblies 18 to be moved to a retracted position. Once the assemblies 18 are fully retracted, further displacement of the tool mandrel 16 will cause the sealing member 34 to be retracted, as shown in the perspective view in FIG. 9. Once in this configuration, the tool may be retrieved to surface, where it may be reset, for example by replacing shear screws 66 (FIG. 3B) and 106 (FIG. 4).

As noted above, a setting tool may be utilized to move the tool 10 towards an extended configuration in which the extendable assemblies 18 and sealing member 34 are brought into engagement with a bore wall. A preferred setting tool, which is suitable for use with the tool 10, will now be described, with reference to FIGS. 10 to 13.

Figure 10:
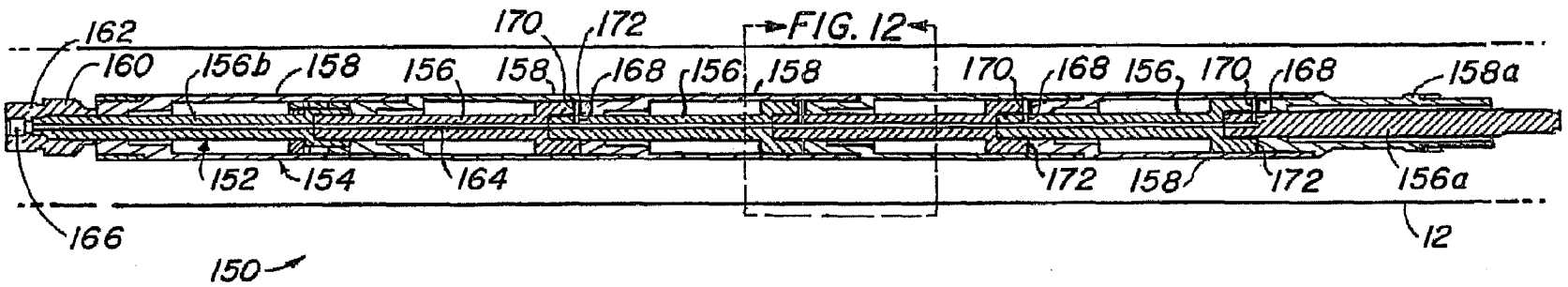
FIG. 10 is a longitudinal sectional view of a setting tool suitable for use in activating the bridge plug tool of FIG. 1, wherein the setting tool is shown in an unstroked, first configuration.

Reference is first made to FIG. 10 in which there is shown a longitudinal sectional view of a setting tool, generally identified by reference numeral 150, shown located within a cased bore, which for convenience is identified by reference numeral 12. The setting tool 150 comprises an inner member 152 and an outer member 154 slidably mounted on the inner member 152. The inner member 152 is formed by threadably coupling together a plurality of inner modular sections 156 end to end, and similarly, the outer member 154 is formed by threadably coupling together a plurality of outer modular sections 158. The lowermost inner modular section 156*a* is adapted to be secured to the upper end of the tool mandrel 16 of the bridge plug tool 10 described above. Additionally, the lowermost outer modular section 158*a* is adapted to be secured to the outer sleeve assembly 30 of the bridge plug tool 10, either directly or preferably via an intermediate connecting sleeve (not shown).

The uppermost inner section 156*b* is adapted to be secured to a further downhole tool (not shown), such as a trigger tool used to actuate the setting tool 150, via a connector 160 which is threadably coupled at one end to the inner module 156*b*, and comprises a nipple portion 162 at the other end for engagement with the further downhole tool. A preferred example of a trigger tool for use in actuating the setting tool 150 of the present invention is described hereinafter with reference to FIGS. 14 to 17.

The inner member 152 defines a central bore 164 extending from an end face of the uppermost inner module 156*b* and terminating in the region of the lowermost inner module 156*a*. The central bore 164 is in selective fluid communication with fluid contained with well bore 12 via fluid port 166 in the nipple portion 162 of the connector 160. Selective fluid communication is achieved by the insertion and removal of a piston member (not shown) into and from the fluid port 166, wherein the piston member forms part of a further downhole tool, an example of which is shown in FIGS. 14 to 17, which is described below.

The inner member 152 further defines a plurality of transverse bores 168 axially distributed along the length of the inner member 152, wherein the bores 168 communicate with the central bore 164. Each transverse bore 168 is aligned with a respective bore 170 formed in the outer member 154, wherein the bores 170 are in fluid communication with respective piston chambers 172 defined between the inner and outer members 152, 154.

Figure 11:
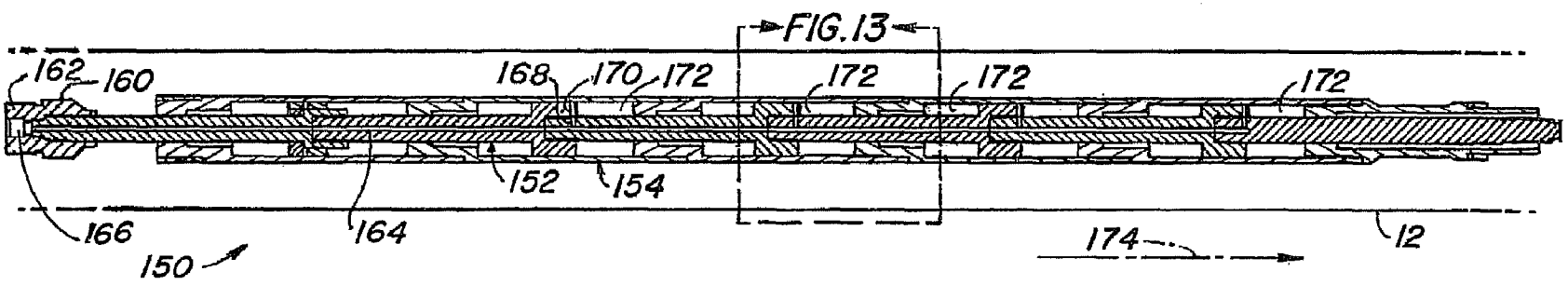
FIG. 11 is a longitudinal sectional view of the tool of FIG. 10, shown in a stroked (setting), second configuration.
Figure 12:
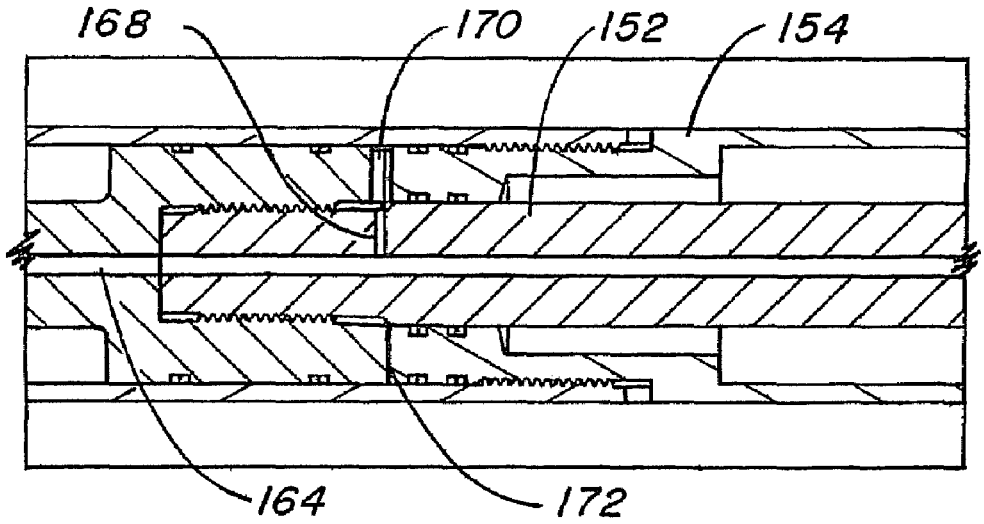
FIGS. 12 and 13 are enlarged part sectional views of a portion of the tool shown in broken outline in FIGS. 10 and 11.
Figure 13:
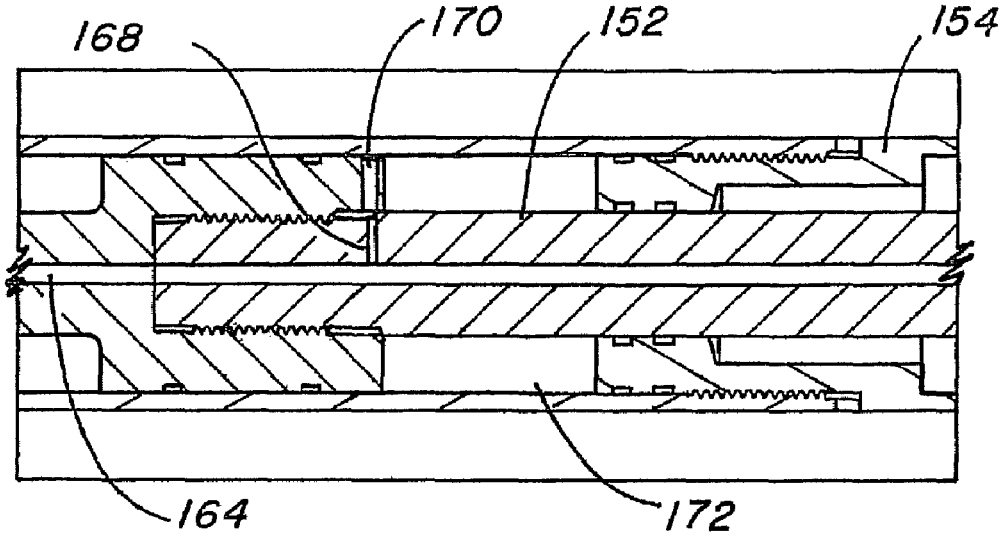

In use, the port 166 is opened which will permit well bore fluid to enter the central bore 164, and into the piston chambers 172 via respective aligned bores 168, 170. The hydrostatic pressure of the well bore fluid will cause the piston chambers 172 to fill with well bore fluid, thus forcing the outer member 154 to move relative to the inner member 152 in the direction of arrow 174, as shown in FIG. 11. Thus, this movement of the outer member 154 may be transmitted to the outer sleeve assembly 30 of the bridge plug tool 10 to reconfigure the bridge plug tool 10. An enlarged view of a piston chamber 172 is shown in FIG. 12 with the outer member 154 in a retracted position, and in FIG. 13 with the outer member 154 in an extended position with the piston chamber 172 filled with well bore fluid communicated from the well bore via bores 164, 168 and 170.

While the setting tool 150 has been described above for use in activating the bridge plug tool 10 of FIGS. 1 to 9, it should be understood that the setting tool 150 may be utilized with any other downhole tool that requires some form of mechanical actuation.

As noted above, the setting tool 150 may be actuated by a trigger tool which permits selective fluid communication between the well bore 12 and the central bore 164 in order to fill the piston chambers 172 with well bore fluid. A trigger tool in accordance with an embodiment of an aspect of the present invention, which is suitable for use in actuating tool 150 will now be described, with reference to FIGS. 14 to 17.

Figure 14:
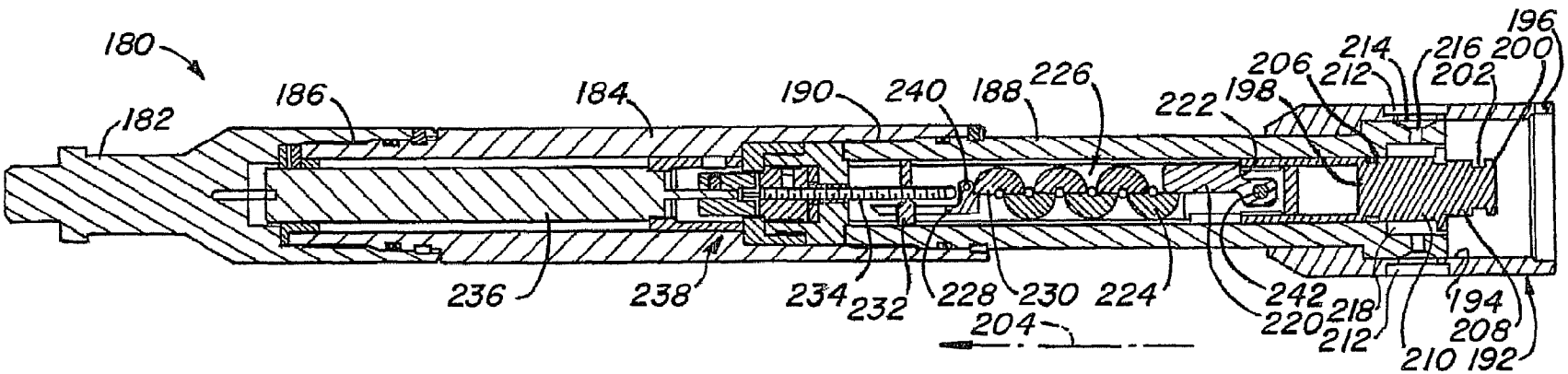
FIG. 14 is a longitudinal sectional view of a trigger tool in accordance with an embodiment of an aspect of the present invention, which may be used in conjunction with the setting tool of FIGS. 10 and 11, wherein the trigger tool is shown in a locked, first configuration.

Referring initially to FIG. 14, there is shown a longitudinal sectional view of a trigger tool, generally identified by reference numeral 180, which may be utilized in conjunction with the setting tool 150 described above. The trigger tool 180 comprises an upper connector 182 for coupling the tool 180 to the lower end of a support (not shown), such as a tubing string, coiled tubing, wireline or the like. The upper connector 182 is coupled to a first tool body 184 via a threaded connection 186, and the first tool body 184 is secured to a lower, second tool body 188 via threaded connection 190. Mounted on the lower end of the second tool body 188 is a lower connector 192 adapted to be coupled to the connector 160 of the setting tool 150 via nipple 162 which is received in bore 194 in the lower connector 192, and secured therein via grub screw 196. It should be noted that in the embodiment shown, no fluid sealing is provided between the connector 160 of the setting tool 150 and the connector 192 of the trigger tool 180, thus permitting the bore 194 to be exposed to well bore pressure.

Slidably mounted within the lower end of the second tool body 188 is a differential plug 198 comprising a piston portion 200, wherein the piston portion 200 is adapted to be received within the port 166 in the connector 160 of the setting tool 150 in order to prevent fluid communication between the well bore 12 and central bore of tool 150. Fluid sealing is achieved between the piston portion 200 and port 166 via a pair of O-ring seals 202 mounted on the piston portion 200, whereas fluid sealing is achieved between the piston portion 200 and the second tool body 188 via a pair of O-ring seals 206, also mounted on the piston portion 200. To actuate the setting tool 150, the differential plug 198 is permitted to move in the direction of arrow 204 under the action of the hydrostatic pressure of the well bore fluid acting across the differential piston between the O-ring seals 202, 206, as described below.

Between the O-ring seals 202, 206, the differential plug 198 defines two dissimilar piston areas that may be exposed to hydrostatic well bore pressure. That is, O-ring seals 202 are mounted on a first section 208 of the piston plug 200, which defines a first diameter, whereas O-ring seals 206 are mounted on a second section 210, which defines a second, larger diameter. Accordingly, the difference in piston area in the presence of well bore pressure exerts a force on the piston plug 200 which will bias the plug in the direction of arrow 204. In order to ensure communication of well bore pressure with the first and second sections 208, 210 of the piston plug 200, a plurality of slots 212 are provided around the outer surface of the connector 192, wherein the slots 212 are aligned with an annular notch 214 and a number of bores 216 formed in the second tool body 188, such that well bore fluid will be communicated to annular chamber 218.

The trigger tool 180 comprises a releasable locking arrangement adapted to maintain the differential plug 198 in the position shown in FIG. 14, in order to maintain the piston portion 200 sealed within the port 166 of the setting tool 150. When required, the locking arrangement is released thus permitting movement of the plug 198 by well bore pressure to open port 166 in tool 150.

Figure 15:
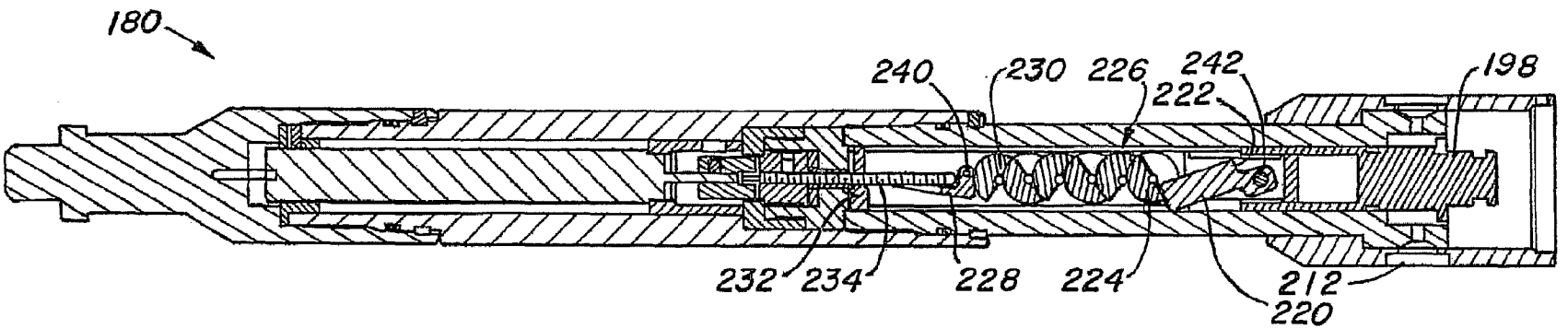
FIG. 15 is a longitudinal sectional view of the trigger tool of FIG. 14, shown in an unlocked (triggered), second configuration.

The locking arrangement comprises a primary lever 220, which is shown in a locked position in FIG. 14, wherein a face 222 of the primary lever 220 engages and restrains the plug 198 from stroking. The primary lever 220 engages a first rolling lever 224 of a linear gear train 226, wherein the linear gear train 226 is locked by a locking lever 228 in which the locking lever 228 engages and is secured between the final rolling lever 230 of the linear gear train 226 and a locking trip nut 232. The locking trip nut 232 is threadably mounted on a lead screw 234, which is adapted to be driven by a wind-up clock mechanism 236 via a torque coupling 238. To unlock the locking arrangement, the lead screw 234 is rotated to move the locking trip nut 232 in the direction of arrow 204, such that the locking lever 228 is free to pivot in a clockwise direction about pivot axis 240, as shown in FIG. 15. Thus, when the locking lever 228 is disengaged from the locking trip nut 232, the pressure force acting on the differential plug 198 will cause the plug to move in the direction of arrow 204 causing the primary lever 220 to pivot in an anti-clockwise direction about pivot axis 242. The primary lever 220 will apply a force on the first rolling lever 224 of the linear gear train, 226, which will be transmitted through to the final rolling lever 230 and ultimately to the locking lever 228 which will be caused to pivot in a clockwise direction. The linear gear train 226 advantageously reduces the force applied on the locking lever 228 and locking trip nut 232 by the external fluid pressure force acting on the plug 198. Otherwise, the force applied would be too great to be overcome by the torque of the wind-up mechanism 236, thus preventing the release of the primary lever 220 to permit movement of the plug 198.

Although the embodiments disclosed use the well bore fluid pressure to create the external force on the differential plug 198 it should be understood that the external force could be provided by an alternate biasing member, such as a spring, for example.

Figure 16:
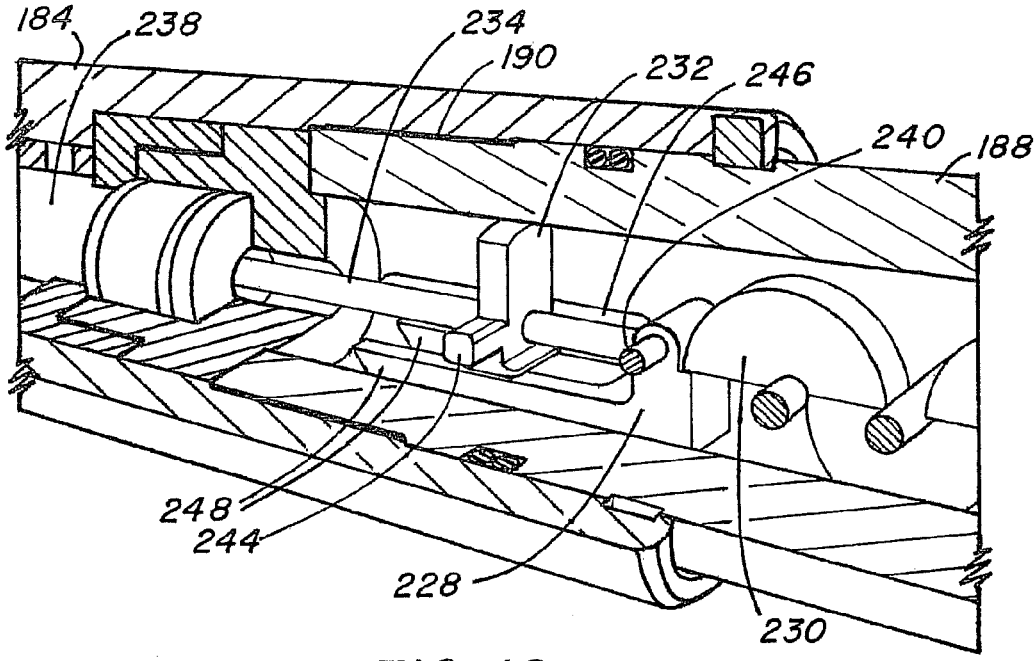
FIGS. 16 and 17 are enlarged part sectional perspective views of the tool of FIGS. 14 and 15, shown in the first and second configurations respectively.
Figure 17:
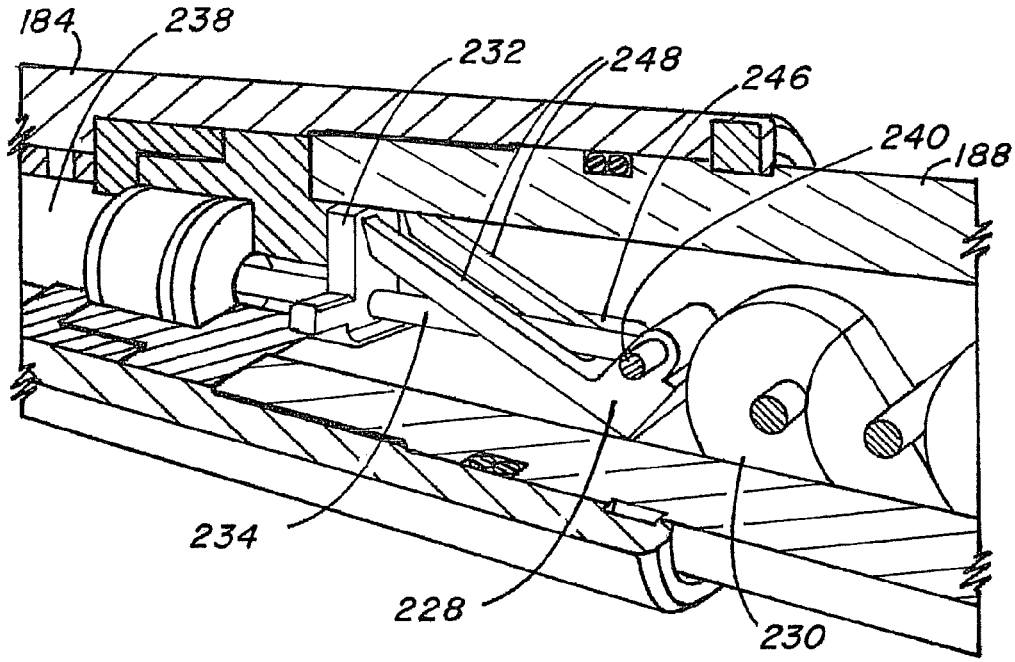

An enlarged part sectional perspective view of the locking arrangement is shown in FIG. 16, in which the arrangement is shown in a locked configuration, and in FIG. 17 in which the arrangement is shown in an unlocked configuration. The locking trip nut 232 comprises a pair of arms 244, which extend into respective elongate guide slots 246 (only one shown) which prevent rotation of the nut 232 as the lead screw 234 is rotated. Additionally, the locking lever 228 comprises a pair of parallel arm 248 which permit engagement with an underside of the locking trip nut 232, while preventing interference with the lead screw 234 when the locking lever 228 is permitted to pivot clockwise about pivot axis 240.

While the trigger tool 180 has been described above for use with the setting tool 150 shown in FIGS. 10 to 13, it should be understood that the tool 180 may be used with any other suitable downhole tool that requires a form of mechanical actuation.

It should be understood that the embodiments described above are merely exemplary and that various variations may be made without departing from the scope of the invention. For example, any number of extendable assemblies 18 may be provided with the bridge plug tool 10, and additionally any number of sealing members 34 may be incorporated.

Additionally, the setting tool 150 may comprise any number of piston chambers 172. Further, the connector 160 may be integrally formed with inner member 152. Furthermore, the tool 150 may be adapted to be coupled to any other suitable tool or tools, and is not limited for use with the bridge plug tool 10 and trigger tool 180 described above. In this regard, any suitable form of connector 160 may be utilized. Additionally, the tool 150 is adapted to be actuated by the hydrostatic pressure of the well bore fluid. However, the tool 150 may be supplied with fluid under pressure from surface level via a suitable conduit.

The trigger tool 180 may incorporate a suitable mechanical drive means, such as an electric motor, or an electronic timer in place of the wind-up clock mechanism 236. Additionally, the wind up clock could be a 12-hour clock such as an Amerada™ 12-hour clock for example. Additionally, the trigger tool 180 may be activated in response to a change in an environmental condition such as pressure, for example. Additionally, the trigger tool 180 may be activated from a remote location, such as the surface, for example. Additionally, any suitable connector may be utilized in place of the connector 192, depending on the form of tool with which the trigger tool 180 is intended to be used.

Figure 18:
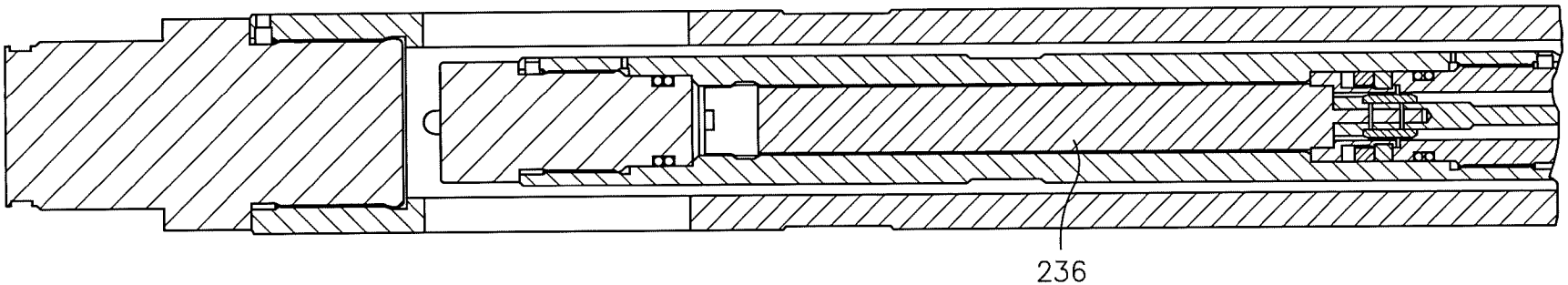
FIGS. 18-20 are an elongated cross-sectional view of an alternate triggering tool.

In another embodiment of a downhole release member/triggering tool, an alternate series of force reducing mechanisms are utilized. More specifically, and referring to FIGS. 18-20, one having read the foregoing disclosure will recognize the clock (windup or otherwise) 236 and the ultimate lead screw 234, which operate identically to the foregoing embodiment. It is to be understood that although the term "clock" is used, the only intended connotation is that of a timer to allow for a specified time before activation or a specified time of activation before cessation of activation. The clock 236 as illustrated in FIG. 18 is connected to lead screw 234 in FIG. 19 through a train of connections that are merely supportive and torque transmissive or both. As such it is necessary to define them in detail.

The lead screw 234 is interactive with a trip nut 300. The trip nut 300 in this embodiment includes an enlarged dimension end 302 that may also include a featured outer surface 304 such as a serrated surface in order to provide indication of linear measurements relating to increments of time. This allows for adjustment of the firing time. Trip nut 300 further includes a following profile 306 configured and positioned to followingly engage the lead screw 234 such that the nut 300 is displaceable axially by the lead screw 234. The pitch of the lead screw 234 is to be selected relative to the speed of the Amerada clock and the desired firing time. This is another adjustability feature. Finally, further adjustment can be made by positioning the trip nut 300 along the length of the lead screw 234 such that the pitch, rotation speed and position all work together to facilitate firing at the appropriate time. The end 302 has a dimension calculated to support a lever 308 in a position that is both poised to trigger actuation of the triggering tool and locked from actuation by the trip nut 300. It should be noted that if the components hereof are properly balanced to reduce contact pressure between lever 308 and outside surface 304, a solenoid axial movement of the nut could be substituted. Higher contact pressures of course preclude the low force generation capability of the solenoid and therefore are better served by the lead screw to avail the force multiplying benefit of mechanical advantage through the use of a screw thread. Lever 308 is pivotally supported at pin 310 and includes a plunger contact arm 312 having a plunger contact face 314. The plunger contact face 314 is of a very small area, which in one embodiment of about 0.00158 square inches. The contact area is selected to transmit a certain amount of force to the lever 308 from components introduced hereunder. The area needs to be sufficient to support the maximum load imparted through the usual action of the plunger.

The angle of contact is also important with respect to transmission of force to the lever 308 and dictates the position/direction of the input force vector. Given that this force is normal to (at right angles to) the plane in which contact occurs, the position of the input force vector relative to the pivot point varies with the angle of the contact plane. The shallower the angle, the shallower the plane; the shallower the plane, the further the vector is from the pivot center of the lever 308; and the farther the vector is from the pivot center of the lever, the lower the mechanical advantage. Therefore, the contact angle between the contact face 314 and a plunger face 316 should be selected to cause the input force vector to extend proximately to the pivot center of the lever 308 but not directly therethrough. An interface angle of about 10 to about 40 degrees has been determined to function well. In one embodiment a more limited angle range is from about 29 degrees to about 31 degrees. In one specific embodiment having the above noted area of about 0.00158 square inches, this equates to a bearing yield strength of 295 Lbf. Under normal operating conditions, which commonly will include environmental pressure outside the tool of about 15,000 psi working on the differential area across a piston 338 (introduced more fully hereunder) the net axial load seen by a plunger 318 (also introduced more fully hereunder) is 35 Lbf this translates to a radial load of 40 Lbf on lever 308 which translates to a downward load on the trip nut of 4.6 Lbs. Altering the angle by +/−1 Deg increases this load by +/−1 Lbf. Due to the low torque of the type of timing mechanism or clock disclosed above, it is axiomatic that deviation in the angle of contact at contact face 314 should be kept to a small range. In one embodiment, the contact angle is about 30 degrees and the range of deviation is, as noted above, from about 29 degrees to about 31 degrees.

Figure 19:
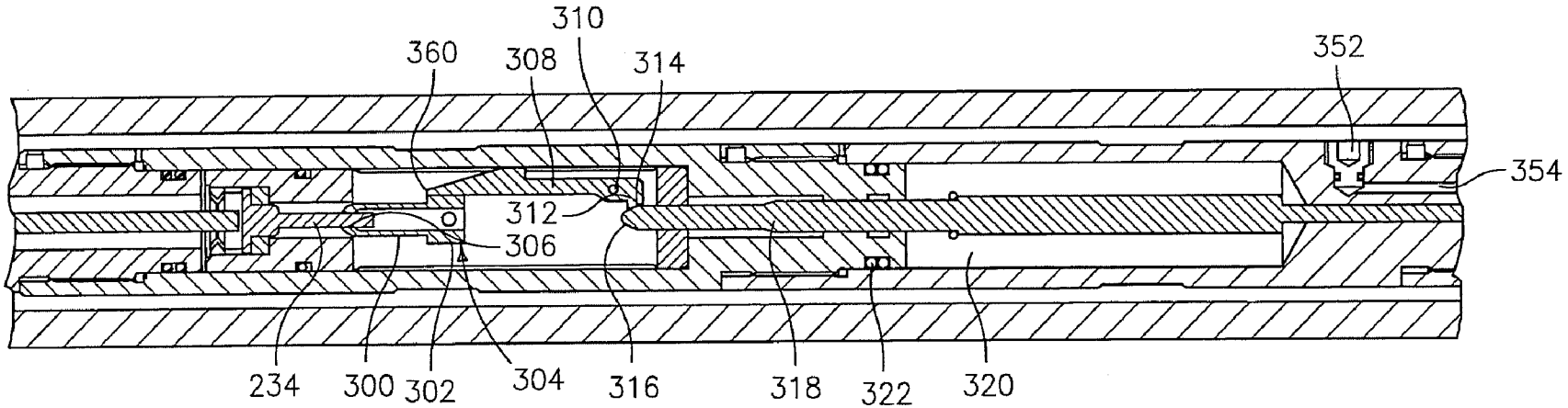
Figure 20:
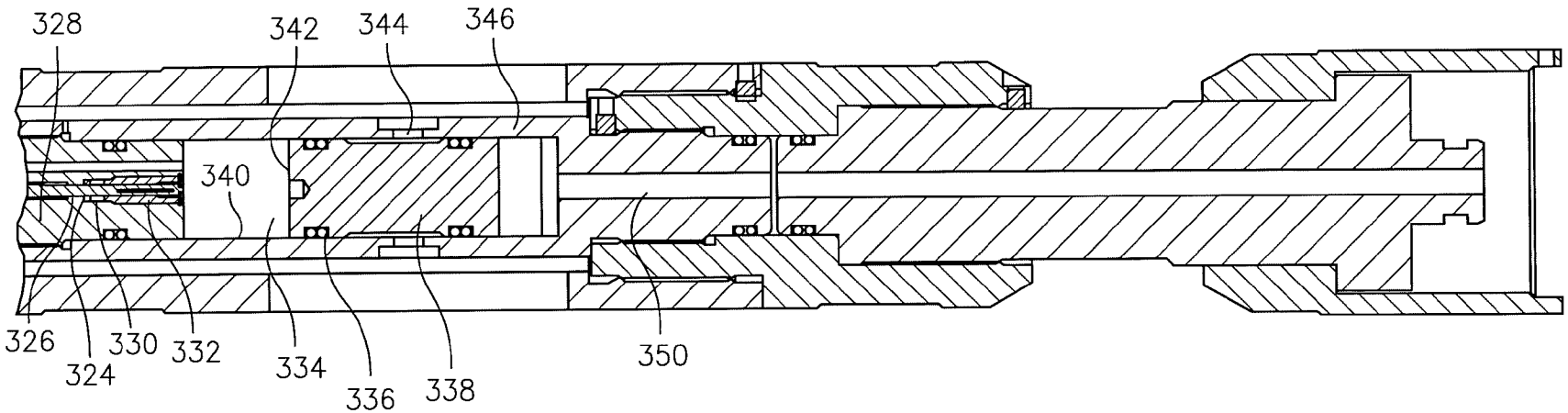

Plunger face 316 is presented by a plunger 318 that extends through an atmospheric chamber 320, which is maintained so by appropriate seals 322 in the various housing structures, the specific configurations of which are incidental. One embodiment is illustrated in FIGS. 18-20 simply for completeness. Plunger 318 includes a reduced diameter end 324 (see FIG. 20) opposite the plunger face 316. Reduced diameter (or non-cylindrical dimensions as there is no requirement that the end necessarily be cylindrical) is received in a closely fitting clearance channel 326 provided in a filler sub 328. The filler sub further includes a seal 330 to seal between filler sub 328 and end 324, which is a diminishing dimension configuration such that when the plunger is allowed to move (leftwardly in the drawing) the seal is defeated. This seal interface is to remain fluid tight during the non-actuated phase of the triggering tool. To improve fluid flow through this interface during actuation of the triggering tool, kerfs 332 are provided in end 324. Kerfs 332 ensure that fluid will flow along end 324 at the appropriate time even if the seal 330 is swollen.

Passage 326 of filler sub 328 is communicated with a fluid chamber 334, the chamber being configured to remain hydraulically locked between a filling event and an actuation event of the triggering tool. The chamber is thus sealed with seals 336 mounted at a piston 338. The piston 338 is sized to slidably reside in a cylinder bore 340 that also defines the chamber 334, the chamber being bounded by a face 342 of the piston 338.

Piston 338 is also exposed to annulus pressure through ports 344 in its housing 346. It should be appreciated that while additional housing components including additional ports are illustrated, they are not necessary. It is to be understood that the "extra housing" is not needed at all but merely has been depicted for accuracy of a single embodiment. All that is required is that annulus pressure is provided at ports 344. The piston 338 is profiled so that where annulus pressure is seen by the piston it is biased toward the plunger 318. Because of the configuration of the profile, the amount of bias is reduced from what would be available from full annulus pressure such that a step down pressure is developed at chamber 334 as opposed to full annulus pressure. For completeness, it is noted that when the trigger tool is actuated, piston 338 moves fully toward plunger 318 thereby exposing channel 350 to annulus pressure through ports 344. Once this occurs, whatever tool is connected to the trigger tool will be supplied with annulus pressure. If it is the setting tool described herein that is attached to the trigger tool, then the setting tool will function as has been described hereinbefore.

Because annulus pressure is generally quite high and a timer or other similar mechanism generally produces very little torque, the pressure-based forces must be significantly reduced from what they are at annulus pressure to what is seen at the clock, timer, solenoid, etc. This is done in a series of steps beginning with the piston 338, which has already been disclosed to step annulus pressure down based upon the profile of the piston exposed to annulus pressure. This step down is realized in chamber 334. It should be noted here that chamber 334 is filled with hydraulic fluid through fill port 352 and conduit 354. Filling may be accomplished at manufacture or at a time of use, as desired. The port is capped in a fluid tight manner for use so that chamber 334 is hydraulically locked. Note that this hydraulic lock (along with the one at end 324) prevents piston 338 from moving toward plunger 318 until the trigger is actuated.

An additional force reduction is achieved at the end 324 of the plunger 318. The cross-sectional area of end 324 is dramatically smaller than an area of piston 338 exposed to annulus pressure. The effect of pressure on the relatively small area of the end 324 only generates a relatively low level force at end 324. This is a second reduction in the total system force.

Although the force applied to plunger end 324 has been reduced, it is still sufficient to move the plunger 318 toward the lever 308, and thus maintains it in contact therewith. Because of the mechanical advantage that lever 308 provides, the bias of the plunger 318 is restrained. Due to the mechanical advantage of the lever on pivot pin 310, an amount of force generated at a lever interface 360 with trip nut end 302 is reduced even further, thus representing a third force reduction in the system. Due to the three phases of force reduction, the contact force at the lever interface 360 with the end 302 is relatively small. This is desirable because it allows the low input triggering force to effectively launch a series of events that ultimately cause actuation of a tool subject to very high ambient hydrostatic force.

In operation, the trigger tool clock 236 is set to countdown. Upon reaching the trigger time, the clock 236 causes lead screw 234 to rotate thereby displacing trip nut 30 from its position supporting lever 308. Upon the desupporting of lever 308, the lever will automatically pivot on pin 310 due to the input force imported by the plunger 318 to move the interface 360 end of lever 308 toward the axis of the tool. The urging of the plunger 318 causes the plunger contact arm 312 to move radially outwardly (in the drawing) while, as noted, the interface 360 end of lever 308 will move radially inwardly. The plunger 318 therefore moves in the direction of lever 308. As plunger 318 moves, which movement is caused by the pressure exerted on end 326 by the hydraulically locked fluid in chamber 334, the kerfs 332 undermine the seal 330 allowing the hydraulically locked fluid of chamber 334 to flow into atmospheric chamber 320. Loss of hydraulic fluid from chamber 334 allows the piston 338 to move to reduce the volume of chamber 334 under the influence of the annulus pressure to which the piston is exposed. Upon fully collapsing chamber 334, piston 338 allows full fluid pressure communication between ports 344 and channel 350. At this point, hydrostatic pressure or applied annulus pressure may be used to operate a setting tool as described herein above.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

The invention claimed is:

1. A downhole triggering tool, comprising:

a tool-engaging portion movable from a first position to a second position under the action of an external force; and a release mechanism for selectively permitting movement of the tool-engaging portion from the first position to the second position, the tool engaging portion being restrained against the external force by the release mechanism through a plurality of distinct force reducing mechanisms.

2. The downhole triggering tool of claim 1 wherein one of the plurality of distinct mechanisms is a piston having a profile expandable to annulus pressure and configured to bias the piston to only a reduced force relative to the annulus pressure.

3. The downhole triggering tool of claim 1 wherein one of the plurality of distinct mechanisms is a plunger, the plunger presenting a smaller cross-sectional area to a fluid chamber than a biased piston pressurized within the fluid chamber.

4. The downhole triggering tool of claim 1 wherein one of the plurality of distinct mechanisms is a lever.

5. The downhole triggering tool of claim 1 wherein the plurality of distinct mechanisms include arrangements creating hydraulic and mechanical advantage.

6. The downhole triggering tool of claim 1 wherein the release mechanism further includes a trip nut end having a featured surface.

7. The downhole triggering tool of claim 6 wherein the featured surface is serrated.

8. The downhole triggering tool of claim 1 wherein the release mechanism includes a lever, a plunger and a contact interface between the lever and the plunger, the interface being at an angle relative to an axis of the plunger that increases mechanical advantage.

9. The downhole triggering tool of claim 8 wherein the angle positions an input force vector from the plunger adjacent a pivot point of the lever.

10. The downhole triggering tool of claim 8 wherein the angle is in a range from about 29 degrees to about 31 degrees.

* * * * *